US005572882A

United States Patent [19]

Schafer

[11] Patent Number: 5,572,882

[45] Date of Patent: Nov. 12, 1996

[54] LOW PRESSURE AIR CYCLE COOLING DEVICE

[75] Inventor: James P. Schafer, Issaquah, Wash.

[73] Assignee: Johnson Service Company, Milwaukee, Wis.

[21] Appl. No.: 505,496

[22] Filed: Jul. 21, 1995

[51] Int. Cl.[6] ..... F25D 9/00

[52] U.S. Cl. ..... 62/402; 418/85

[58] Field of Search ..... 62/401, 402, 86; 418/85

[56] References Cited

U.S. PATENT DOCUMENTS

| | | | |
|---|---|---|---|
| 4,088,426 | 5/1978 | Edwards | 418/8 |
| 4,175,398 | 11/1979 | Edwards et al. | 62/172 |
| 4,187,692 | 2/1980 | Midolo | 62/402 |
| 4,187,693 | 2/1980 | Smolinski | 62/402 |
| 4,261,184 | 4/1981 | Stout | 62/402 |

*Primary Examiner*—Ronald C. Capossela
*Attorney, Agent, or Firm*—Harness, Dickey & Pierce, P.L.C.

[57] ABSTRACT

A low-pressure air cycle cooling device for cooling the air in a space. The invention includes a cooling chamber, generally drum-like in form, whose interior is defined by end caps and the chamber inner wall. A powered rotor assembly is carried in the chamber, with rotor vanes carried in slots formed in the rotor. The vanes move outward as the rotor rotates, extending to the vicinity of the chamber wall. Vane tips interact with the air in the vicinity of the chamber wall, producing an air bearing effect that minimizes friction while substantially sealing the volume between adjacent vanes. The chamber is generally ovoid in shape, with the long axis being pinched to produce a waist, demarked by pinch points. In the vicinity of such pinch points the chamber wall is curved inwardly concave, while the remainder of the chamber is curved outwardly convex. Four ports are formed in the chamber wall, two of which communicate with the cooled space and two connect with a heat exchanger. The chamber inner wall is divided into a number of zones for performing thermodynamic operations on parcels of air carried between adjacent vanes. The device operates as a rotary vane pump according to the reverse Brayton cycle, in which parcels of air are collected as a pair of vanes passes an inlet port, the parcel of air is compressed, heat is rejected by the heat exchanger, and the parcel is expanded. Cooled air is then exhausted to the space.

4 Claims, 3 Drawing Sheets

LOW PRESSURE AIR CYCLE COOLING DEVICE

BACKGROUND OF THE INVENTION

This invention relates generally to the field of refrigeration and cooling devices, and more particularly to the field of devices used to provide conditioned air to a space.

Conventional air conditioning devices employ a refrigeration cycle that harnesses the cooling effect accompanying evaporation of a fluid within a closed environment. Ordinarily, this fluid has been a liquid, and that simple fact has long prompted the art to seek a workable method for air conditioning using air itself as the cooling medium. The recognition that conventional refrigerants may pose environmental hazards, and the resulting regulation of fluids such as the CFC and HCFC families of refrigerants, has intensified that search.

The basic facts have been known for some time. The process for directly cooling air is delineated in the so-called "reverse Brayton cycle" (or "air cycle"), which describes the thermodynamic process of compressing air, rejecting the heat of compression, and then expanding the air to cool it below its starting temperature. Applying this theoretical knowledge has proved difficult, however.

The most promising development by the prior art has been the series of patents issued to Thomas C. Edwards and his co-workers, beginning with U.S. Pat. No. 3,686,893 in 1972. This voluminous collection of patents discloses a cooling system based on a rotary vane compressor-expander. In general, Edwards envisioned a rotary vane device carried in an elliptical housing, in which vane travel is controlled by rollers actuated by various camming arrangements carried in the end plates of specific embodiments. Inlet and outlet ports, are provided, often with provisions for controlling noise produced by pressure differentials (e.g., U.S. Pat. No. 3,905,204) or with provision for adding moisture to the air (e.g., U.S. Pat. No. 4,017,285). The geometry of the compressor-expander body is not generally addressed, but in U.S. Pat. No. 4,086,426, the structure is disclosed as elliptical, with the elliptical eccentricity of the expander side being slightly less than that of the compressor side of the device. Various others of these patents address particular aspects of this system, such as controlling vane travel (e.g., U.S. Pat. No. 3,886,764), providing a low-friction bearing surface for the vane (e.g., U.S. Pat. No. 3,904,327), and similar features.

After more than twenty years of development, however, no successful commercial embodiment of the Edwards inventions has been introduced. The inherent complexity of these devices, as seen in the patents, may have prevented the development of embodiments that could effectively compete in the marketplace. Thus, the art still awaits a device that can employ air cycle cooling in a manner that is not only effective but is also economically feasible. That is precisely the result achieved by the present invention.

SUMMARY OF THE INVENTION

The broad objective of the present invention is to provide a device that provides effective cooling using air as the refrigerant fluid.

A further object of the invention is to provide an effective air-cycle cooling device that can be fabricated simply and economically.

Yet another object of the invention is an air-cycle cooling device adaptable through a wide range of applications to service a number of cooling needs.

These and other objects are achieved in the present invention, a low-pressure, air cycle cooling device. The invention generally includes a cooling chamber, generally drum-like in form, which in turn has a chamber housing with end caps disposed over its open ends to define a chamber interior. The chamber housing also has an inner wall. A rotor assembly includes a generally cylindrical rotor body, carried by the end caps for driven rotary motion within the chamber. A group of circumferentially spaced radial slots is formed in the rotor body, and rotor vanes slidingly carried in them, dimensioned to enable each vane to extend radially toward the housing body inner wall while carried in its slot. A drive mechanism, such as a motor, is operatively connected to the rotor body.

The chamber inner wall is subdivided into a number of zones, extending around the chamber in the direction of rotation of the rotor body. These zones are defined and function as follows: An inlet port zone includes a first pinch point lying at a radial distance substantially equal to the radius of the rotor body, such that a close clearance fit exists between the first pinch point and the rotor body. This zone includes an inwardly concave curved portion and an outwardly convex portion. A compression intake zone lies adjacent the inlet port zone in the direction of rotation of the rotor body, the chamber wall within the compression intake zone having a substantially constant radius. A compression zone is adjacent the compression intake zone in the direction of rotation of the rotor body, the chamber wall within the compression zone having a radius that decreases. A compression outlet zone, adjacent the compression zone in the direction of rotation of the rotor body, has a second pinch point lying at a radial distance substantially equal to the radius of the rotor body, such that a close clearance fit exists between the second pinch point and the rotor body, with an inwardly concave curved portion and an outwardly convex portion. An expansion inlet port zone lies adjacent to and symmetrical with the compression outlet zone. Next is an expansion intake zone, adjacent the expansion inlet port zone in the direction of rotation of the rotor body; the chamber wall within this zone has a substantially constant radius. An expansion zone follows in the direction of rotation of the rotor body, with its chamber wall having an increasing radius. An outlet port zone is next and is symmetrical with the inlet port zone.

The following ports are formed in the chamber wall: An inlet port, in the chamber wall of the inlet port zone; a compression outlet port, in the chamber wall of the compression outlet zone; an expansion inlet port, in the chamber wall of the expansion inlet port zone; and an outlet port in the chamber wall of the outlet port zone. The inlet and outlet ports allow input from and provide output to the cooled space, while a heat exchanger is connected between the compression outlet port zone and the expansion inlet port zone through the compression outlet port and the expansion inlet port.

DETAILED DESCRIPTION OF A PREFERRED EMBODIMENT

Figure 1:
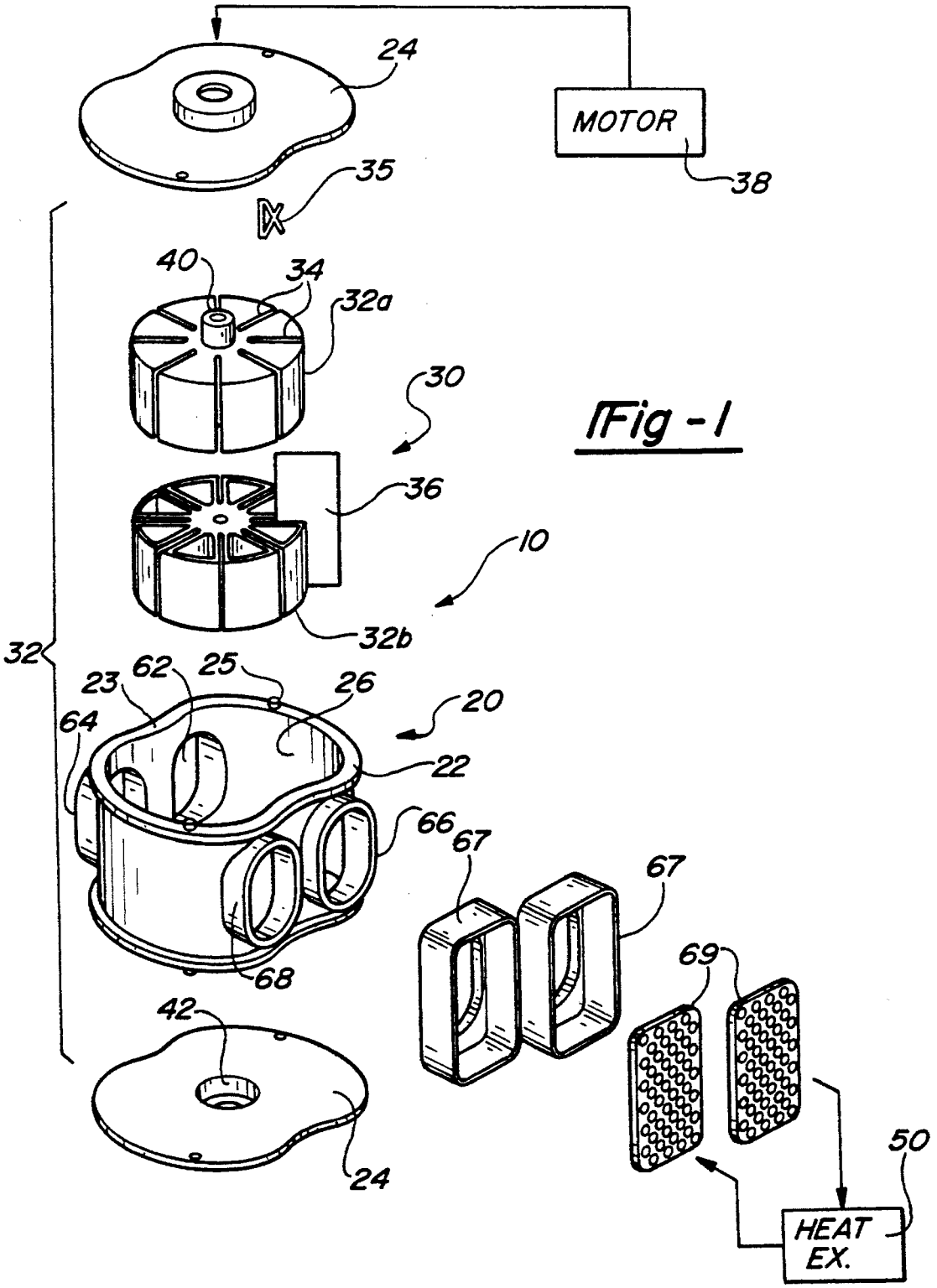
FIG. 1 is an exploded pictorial view of a preferred embodiment of the invention.

A cooling device 10 according to the present invention is shown in FIG. 1. It should be understood from the outset that the present invention can be applied to a wide range of applications, each of which would dictate particular constructional features. At one end of the spectrum, the invention could be embodied in an apparatus for providing spot cooling to electronic devices. Such a device would of necessity be small, sized to fit on or in an equipment cabinet and provided with appropriate ducting. Conversely, another embodiment could be used to cool a large enclosed space, such as a room or building, in residential, commercial or industrial settings. Such a unit would be larger by several orders of magnitude and would require different ancillary details, but it would operate under the same basic principles as the smaller device. The embodiment discussed herein is therefore illustrative of, but not limiting to, the invention.

The device shown here lies between those extremes of size, and would be suitable for providing incremental cooling to a person at a workstation, desk, cubicle, office or similar environment. The term "incremental cooling" denotes a situation in which a primary cooling system (such as a conventional HVAC system serving an entire building, for example) maintains the ambient temperature within a zone at a selected level, generally several degrees above an expected comfort zone, while the apparatus disclosed here is mounted at individual workstations so that individuals can adjust the ambient temperature at that location to a desired level. The dimensions and constructional details noted in connection with this embodiment reflect such use.

The cooling unit generally divides into three assemblies: the cooling chamber 20, the rotor assembly 30 and the heat exchanger 50. Each of these is discussed in detail below.

The cooling chamber is generally formed as a drum, with a chamber housing 22 and two generally flat end caps 24. The inner wall 26 of the chamber housing, together with the end caps, defines the working portion of the cooling chamber. It is preferred to form the cooling chamber components by injection molding a structural foam polycarbonate plastic material. It will be understood that the key factors in choosing the material for a given embodiment are strength and weight, and those in the art can select materials accordingly. For the individual cooling device contemplated here, it is preferred that the chamber have a long dimension of about 200 mm and a short dimension of about 150 mm, with a depth of about 100 mm. The exact geometry of the chamber will be described below. The end caps are secured to the chamber housing by suitable means, such as spring clips or screw fasteners, using conventional sealing techniques appropriate to the pressure expected within the chamber. A mounting flange 23 with mounting pegs 25 can be provided on the open ends of the housing to facilitate assembly. Further details of the housing are discussed below in connection with the functional analysis of the chamber.

Four ports pierce the chamber housing, grouped in pairs. On one side of the housing are the inlet and outlet ports 62 and 64, respectively. Opposite those ports are the compression outlet port and expansion inlet ports 66 and 68, respectively. Each port is provided with a mount 63 for connections with other components. These ports will be better understood following the description of their operation, below.

Figure 3:
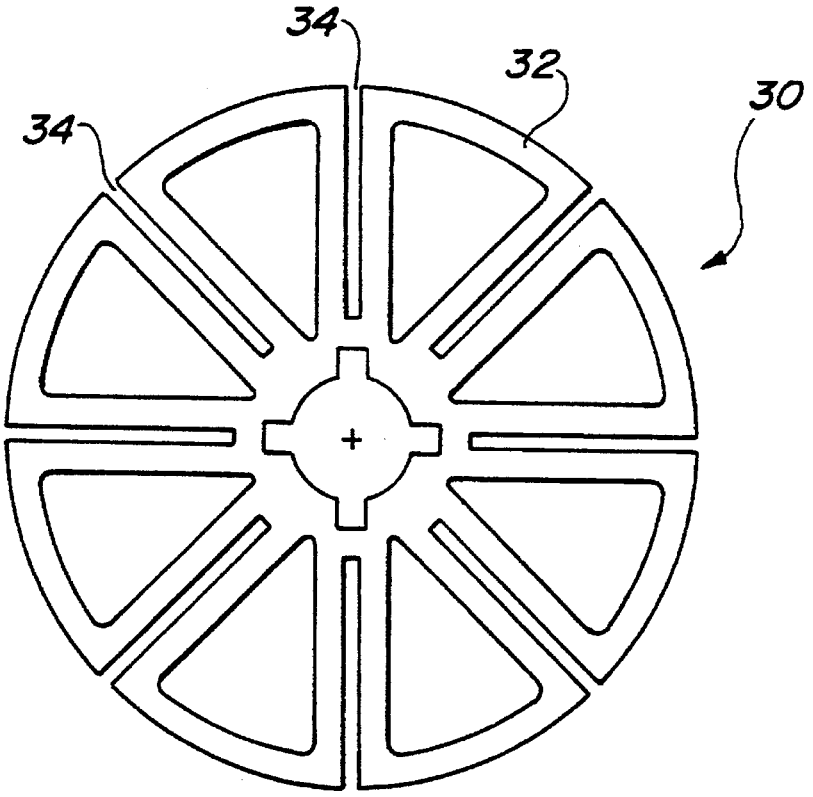
FIG. 3 is a sectional plan view of the rotor of the embodiment shown in FIG. 1.

The rotor assembly 30 includes a cylindrical rotor body 32, with radial slots 34. For minimum weight, it is preferred that the rotor be hollow, with material surrounding the slots, which design can be realized by molding upper and lower rotor halves 32*a* and 32*b*, respectively, which halves are joined by an appropriate adhesive. As also seen in FIG. 3, a total of eight slots are provided, equally spaced around the circumference of the rotor, and each extending radially toward the rotor axis.

Figure 4:
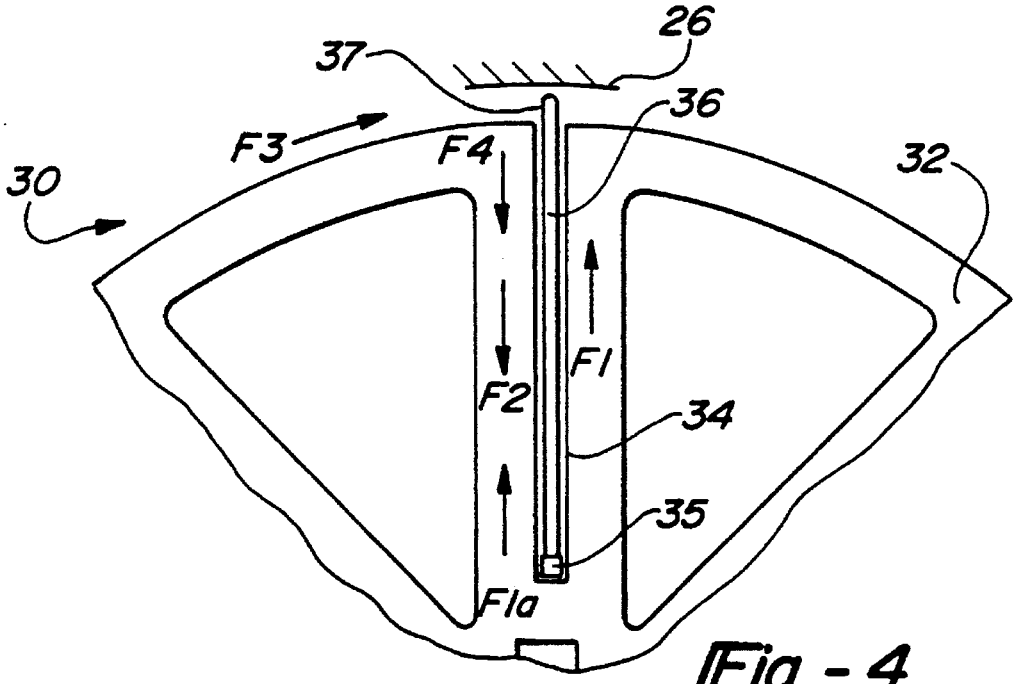
FIG. 4 is a detail view of the operation of a vane tip according to the present invention.

Vanes 36 are provided for each slot. It is preferred that the slot width be about 3.5 mm and the vane thickness be about 3 mm, so that the vane freely slides within the slot. Vane length is chosen such that the maximum vane length allows the vane to retract fully into the radial slot when opposite the minimum chamber dimension, yet extend fully to engage the housing inner wall at the maximum dimension, while retaining sufficient material within the radial slot to provide stability. For the present embodiment, a vane length of about 46 mm is selected. Design choice for other applications will be straightforwardly performed by those in the art. Vane tip 37, best seen in FIG. 4, exercises an important effect on the aerodynamic operation of the vane, as discussed in detail below. As seen in FIG. 4, it is preferred that the vane tip be generally semicircular.

Depending on the needs of a given embodiment, vane springs 35 may be useful in insuring proper vane travel, as discussed below. The particular requirements of an embodiment will dictate the spring chosen for that application, as known by those in the art. The preferred embodiment shown here calls for a flat "bowtie" spring, fabricated from spring wire of about 0.040 inches in diameter, carried in each vane slot below the vane, as best seen in FIG. 4.

The choice of materials can assist the free movement of the vane. The rotor can be formed from the same material as the chamber housing, but enhanced performance is gained by forming the vanes from an engineering plastic that includes an impregnated lubricant, such as the material sold under the trademark DELRIN by DuPont, preferably with added fibers of TEFLON, also from DuPont, which is readily available to the art from commercial sources. Additional vane design criteria are discussed below.

The rotor is driven by motor 38, mounted on an end cap, with a drive shaft 40, which is journaled on bearings 42 carried on each end cap and suitably engaged to the rotor. The motor selection lies well within the skill of the art, and thus the motor is shown schematically in FIG. 1. It is preferred to employ an electric motor capable of driving the rotor at speeds ranging from several hundred to several thousand rpm. Cost, noise and reliability are key selection criteria, as is conventionally understood.

A heat exchanger 50 connects the compression outlet port 66 and the expansion inlet port 68. The function of this device is discussed below, but its construction is generally conventional, and therefore depicted schematically in FIG. 1. Any of several familiar designs may be chosen, but it is preferred to use a simple tube bundle, incorporating ⅜ inch aluminum or copper tubing, conventionally joined and connected to the respective ports by manifolds 67 carried on mounts 63, each manifold further carrying a tube mounting plate 69. The anticipated heat rejection requirement dictates the exact design, and the planned location of the unit influences the construction details, as are well known. Heat rejection can be improved by providing a shroud over the tube bundle and flowing air through the bundle with a small fan (neither shown). Further details regarding the preferred embodiment are set out in the operational discussion below.

Figure 2:
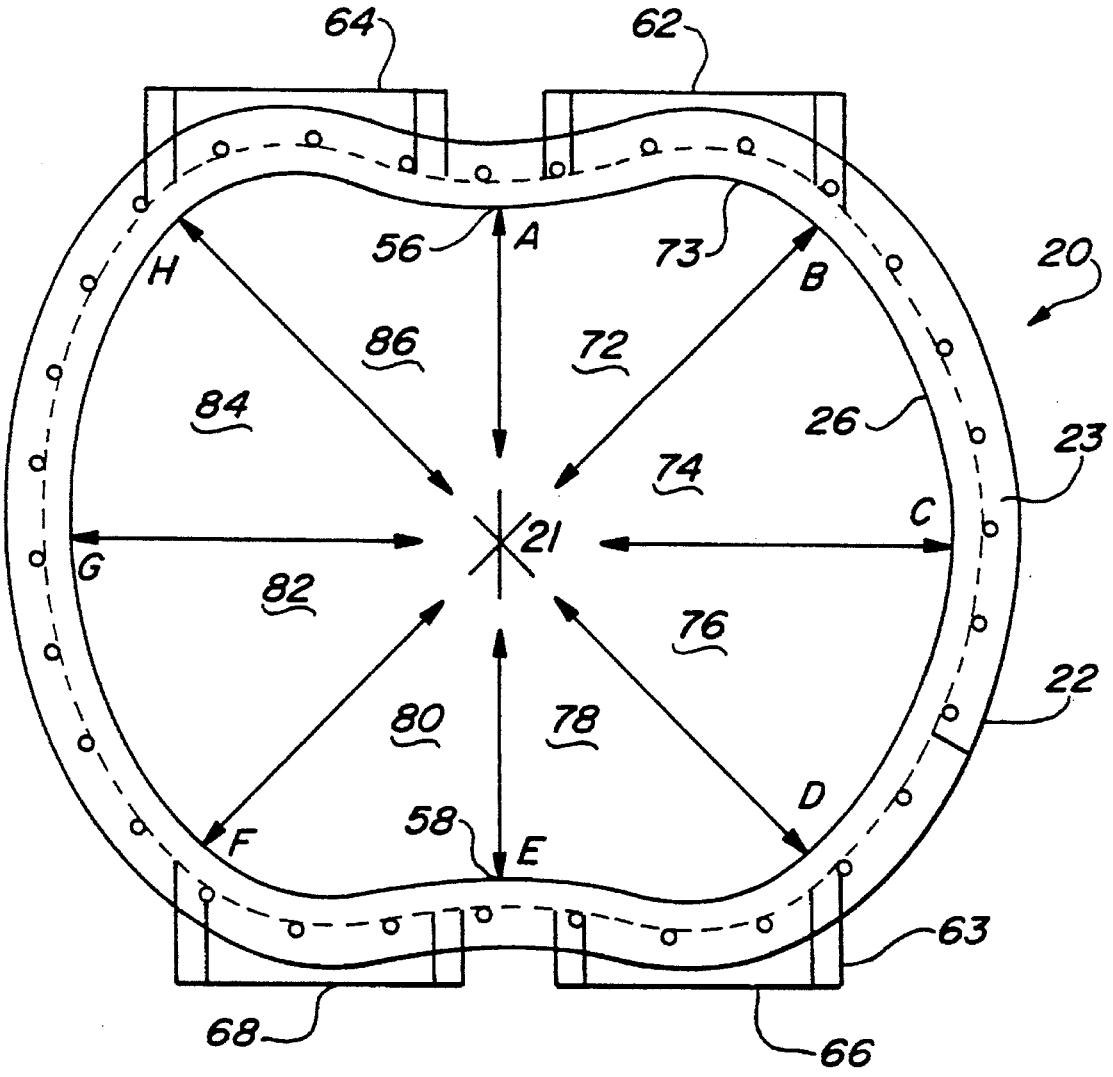
FIG. 2 is a schematic representation of the cooling chamber of the embodiment shown in FIG. 1.

Turning to the schematic representation of FIG. 2, it can be seen that the present invention is a species of rotary vane pump, with the vanes 36, the rotor 32 and the housing inner wall 26 defining distinct parcels of air that are moved through the system from inlet to outlet.

A key feature of the present invention is that the housing inner wall 26 is divided into a number of distinct zones, each having a geometry designed to perform a specific thermodynamic operation on the parcel of air moving through that zone. In the embodiment illustrated here, eight zones are employed. That number is chosen as the minimum number required to perform each of the tasks outlined below. A larger number of zones could be used, but increasing the number of zones increases the complexity, noise and cost of the system. Zones are thus defined as portions of the housing inner wall swept by a vane during 45 degrees of rotor rotation. The demarcation between adjacent zones is never abrupt, to prevent undue wear on the vanes, but rather are gradual changes from one wall geometry to another, as discussed below. For convenience, zone boundaries are labelled A through H in the drawings and separated by arrow lines.

The structure and function of each zone is as follows. In this discussion, a "parcel" of air is a volume of air defined by two vanes, the rotor and the housing inner wall. A given parcel is said to lie "in" a given zone from the point where the leading vane enters that zone until the trailing vane leaves the zone. It should be noted that the following discussion is based on a clockwise rotor rotation direction. If it is desired to employ counterclockwise rotation, the structure should be reversed, as would be readily comprehended by those in the art.

The chamber housing is generally ovoid in plan, but it departs from the prior art in having a distinct "waist" portion, where the curvature of the housing wall becomes inwardly concave—that is, the center of curvature lies outside the chamber. Here the chamber narrows to a "waist" extending between first and second pinchoff points 56 and 58, respectively. The remainder of the housing curvature is outwardly convex, with each zone having its own geometry. It should be noted that the rotor axis 21 is located at a point defined by the intersection of a first line joining the first and second pinchoff points and a second line longitudinally bisecting the chamber. This point is not the true geometric center of the chamber, given the chamber geometry discussed below, but all radial distances given below, and referred to as "chamber radius", are measured from this point.

The following discussion first treats the chamber structure in some detail and then turns to a functional analysis of the system.

The inlet port zone 72 starts at the first pinchoff point 56 (point A) and extends to the end of the inlet port 62 (point B). This zone performs the function of collecting a parcel of air from the inlet port 62 between adjacent vanes. As noted above, this section of the housing wall is curved inwardly concave at the pinchoff point, with that curve smoothly varying to meld with outwardly convex joining curve portion 73. The joining curve portion is selected to effect a smooth transition with the succeeding zone, as described below. In the illustrated embodiment, it is preferred that the chamber radius at the first pinchoff point is about 65 mm and the chamber radius at the end of the inlet port zone is about 98 mm. It has been found that the specific dimensions of the pinchoff points are significant in controlling the ability of the vanes to maintain contact with the chamber wall, and thus those in the art will appreciate the need to experiment with particular sizing, based on the needs of a given application.

The next adjacent zone is the compression intake zone 74. This zone begins at the edge of inlet port 62 (point B) and continues to about the longitudinal midpoint of the chamber (point C). It cooperates with the inlet port zone to draw an air parcel into the chamber, as described below. This housing wall in this zone describes a constant radius, which in the preferred embodiment is about 98 mm.

The compression zone 76 is next, extending from point C to the beginning of compression outlet port 66 (point D). Here the air parcel is compressed, as the housing wall radius decreases. It is preferred that the radius decrease linearly across the zone, from a preferred value of 98 mm to 87 mm. This geometry accomplishes the desired compression while minimizing the inward acceleration of and wear on the vane. It is important to note that the level of compression produced here is deliberated maintained at a low level. The high compression sought by the prior art led directly to the complexity of and problems with such devices. It is estimated that favorable results can be achieved by limiting the pressure rise in the compression zone to values between ½ psig and 4 psig, which could be achieved with radius reduction of between about 4% and 25%. The preferred design calls for a radius reduction of a bit over 5%, producing a maximum pressure within the compression zone of about 2.5 psig.

Lying next in the chamber is the compression outlet zone 78, which begins approximately coincident with the compression outlet port (point D) and continues to the second pinchoff point 58 (point E). This zone is shaped much like the inlet port zone, with an inwardly concave portion in the vicinity of the pinchoff point and an outwardly convex joining curve smoothly joining the concave portion and the curve of the compression zone. The preferred chamber radius in this zone begins at about 87 mm and reaches about 65 mm at the second pinchoff point.

The expansion inlet port zone 80 commences at the second pinchoff point (point E) and extends to the end of the expansion inlet port 68 (point F). This zone is a mirror image of the compression outlet zone 78, with dimensions preferably identical to the dimensions of that zone, with an initial chamber radius of 65 mm and ending radius of 87 mm.

The expansion intake zone 82 performs a transport function similar to that of the compression intake zone, and similarly features a constant radius throughout, from the edge of the expansion inlet port 68 (point F) to the longitudinal midpoint of the chamber (point G). It will be noted that the radius of this zone is preferably 87 mm. This is smaller than the radius of the compression intake zone, occasioned by the fact that the parcel is still compressed at this point.

Expansion zone 84 performs the expansion function, between point G and the edge of the outlet port 64 (point H). The radius of the housing wall in this zone increases, preferably linearly, from an initial value of 87 mm to 98 mm at the outlet port. This the same curve as that of the compression zone.

The outlet port zone 86 is the final sector of the chamber, extending from the edge of the outlet port 64 (point H) to the first pinchoff point (point A). This zone is a mirror image of the inlet port zone 72, with identical curvature and dimensions.

The four ports (inlet port 62, outlet port 64, compression outlet port 66 and expansion inlet port 68) are formed in the housing. It is important that these ports be sized as large as possible, to minimize air pressure loss through the unit. It is thus preferred that the ports be formed as ovoid apertures in the housing wall, occupying the majority of housing wall area in their respective zones. Port mounting flanges 63, preferably formed into the housing and projecting outward, can be provided to facilitate mounting the heat exchanger 50 on the compression outlet port 66 and expansion inlet port 68, and for mounting air intake and outlet devices (not shown). The exact form of the latter devices depends on the particular application for which the embodiment is designed. In one configuration, the cooling apparatus could be mounted under a desk or workstation. There, ducting, either built into the furniture itself or attached to it, could draw in air at a desired point in the work area and discharge it at another point. Such details are highly variable and form no part of the present invention but are provided for illustration only.

The design and operation of the vanes 36 are interrelated with the design of the housing, as seen in FIG. 4. As has been emphasized, the present invention does not seek or achieve high compression of the working fluid. This characteristic allows the invention to avoid the problems encountered by the prior art in devising a vane system that could establish a high-pressure seal against the housing wall without imposing high vane-tip friction and wear. This class of problems is entirely bypassed by the present invention, where the vanes must only seal against a pressure of about 2.5 psi. This low pressure can be maintained while providing a clearance of 5–10 thousandths of an inch between the vane tip and the chamber wall. The seal is achieved by the dynamic interaction between the vanes 36, the rotor 30 and the housing inner wall 26. As the rotor turns, the vanes are forced outward by a combination of centrifugal force F1 and vane spring force F1*a*, toward the housing wall. This force is, of course, proportional to the rotor speed and the mass of the vane, plus the spring force. Initially the centrifugal force is counteracted only by friction F2 between the vane and the radial slot 34. This force is likewise proportional to the rotor speed, as the drag F3 produced by the air resistance to the movement of the vane increases due to increasing speed of the vane as well as the increase in vane area on which this force acts. As the vane tip 37 approaches the housing wall, however, aerodynamic factors come into play. In a manner analogous to the operation of a computer disk head, the airflow between the vane tip and the housing wall exerts forces on the vane having an inwardly radial component F4.

Appropriate design choices can produce a system in which the vane "floats" on an air bearing layer a few thousands of an inch in thickness. The factors that seem paramount are the vane tip configuration, vane mass, vane spring, radial slot dimensions, vane and rotor materials, and rotor speed. These variables do not lend themselves to theoretical calculation, and each application requires an experimental, empirical determination of design values. Such experimentation lies within the skill of those in the art. For the present application, these factors have been discussed above or will be discussed below. It should be clear, however, that employment of the air bearing principle minimizes vane tip friction, and, consequently, minimizes vane tip wear as well.

This embodiment is dimensioned to produce incremental cooling for an individual workstation, desk or cubicle. By that it is meant that the device is designed to accept ambient air at about 75 degrees (Fahrenheit) and to discharge air at about 60 degrees. The device must provide a sufficient volume of air to provide for the needs of a single person, or about 30 liters of air per second. Clearly, the air volume will depend on the rotor speed, which can vary between a minimum value, barely sufficient to cause the vanes to extend into aerodynamic engagement with the housing wall, or about 100 rpm, and a maximum speed of several thousand rpm. Exact speeds, of course, will vary with the particular components chosen for an application. Those in the art will understand that factors such as noise will also affect the choice of operational parameters.

Operation of the apparatus can best be appreciated by following a parcel of air through a complete operational cycle in the device. Such a parcel is defined by a pair of vanes, which for purposes of this discussion will be assumed to begin at points A and H (FIG. 2). This analysis assumes steady-state operation, with the motor turning at a normal operating speed, in a clockwise direction.

As the leading vane moves from point A to point B across inlet port zone 72, the area between the vanes is increasingly open to inlet port 62, and as the leading vane continues to point C, a parcel of air is drawn into the chamber by the rotational action of the vanes. The geometry of this zone promotes this action, as the first pinchoff point 56, lying close to the rotor, promotes high volumetric efficiency by exhausting a high proportion of the previous parcel from the inter-vane area. This effect is inherently impossible in prior art designs in which the chamber is outwardly convex throughout the device. It also should be noted that intake into the chamber is promoted by the constant radius of compression intake zone 74. Arrival of the trailing vane at point B seals the parcel within the chamber, and at that point the processing can begin. Moving from point C to point D, through the compression zone 76, the chamber radius decreases, likewise decreasing the parcel volume. The temperature and pressure of the parcel rise in response to this action. The particulars of the chamber geometry are discussed above. The compression that occurs in this zone requires an expenditure of work by the motor.

In the compression outlet zone 78 the parcel is exhausted to heat exchanger 50, where the heat of compression is rejected. At nominal conditions, the inlet air temperature should be about 75 degrees F., as noted above. Compression should raise that temperature to about 100 degrees. The heat exchanger is designed to lower the parcel temperature to about 80 degrees, with a pressure drop of only about one inch of water. These criteria lie well within the capabilities of convention designs and should pose no obstacle to those in the art.

The expansion inlet port zone 80 and expansion intake zone 82 mimic the actions of the inlet port zone and compression intake zone discussed above, drawing the parcel from the heat exchanger back into the chamber. As noted above, the second pinchoff point 58 facilitates the movement of the parcel out of and into the chamber. The chamber radius at point G is smaller that the radius at corresponding point C, allowing for the reduced volume of the parcel, which remains under pressure at this point.

From point G to point H the increasing chamber radius expands the parcel, cooling it to below its starting temperature. The maximum cooling that can be achieved by the present invention depends on the maximum compression that can be achieved without excessive leakage at the vane tips. This maximum value has not been experimentally determined but is believed to be about 25 degrees F. As set out in the embodiment discussed here, cooling of 15 degrees F. seems very reasonably achievable. During the expansion process, work is returned to the rotor.

The final step is exhausting the parcel as the vanes move across the outlet port zone 86, from point H to point A. The fact that the present invention operates at low pressure obviates the pressure-matching and noise reduction measures seen in the prior art.

Those in the art will understand that many changes and variations in this design can be made within the spirit of the invention. As noted above, the invention can be embodied in a variety of applications, each requiring individual dimensions and construction details. Vane design, for example, is a matter of experiment in each application. These and other variations, however, lie within the scope of the invention, which is defined solely by the claims appended hereto.

I claim:

1. A low-pressure, air cycle cooling device, for incrementally cooling the ambient air within a space, comprising:

a cooling chamber, generally drum-like in form, having a chamber housing and end caps disposed over the open ends thereof to define a chamber interior, said chamber housing having an inner wall;

a rotor assembly, including a generally cylindrical rotor body, carried by said end caps for driven rotary motion within said chamber, and further including a plurality of circumferentially spaced radial slots formed in said rotor body;

rotor vanes slidingly carried in said radial slots, dimensioned to enable a said vane to extend radially toward said housing body inner wall while carried in a said slot;

drive means operatively connected to said rotor body;

wherein said chamber inner wall includes an inlet port zone in which said wall includes a first pinch point lying at a radial distance substantially equal to the radius of said rotor body, such that a close clearance fit exists between said first pinch point and said rotor body; an inwardly concave curved portion; and an outwardly convex portion;

a compression intake zone, adjacent said inlet port zone in the direction of rotation of said rotor body, the chamber wall within said compression intake zone having a substantially constant radius;

a compression zone, adjacent said compression intake zone in the direction of rotation of said rotor body, the chamber wall within said compression zone having a radius that decreases;

a compression outlet zone, adjacent said compression zone in the direction of rotation of said rotor body, and having a second pinch point lying at a radial distance substantially equal to the radius of said rotor body, such that a close clearance fit exists between said second pinch point and said rotor body; an inwardly concave curved portion; and an outwardly convex portion;

an expansion inlet port zone adjacent to and symmetrical with said compression outlet zone;

an expansion intake zone, adjacent said expansion inlet port zone in the direction of rotation of said rotor body, the chamber wall within said expansion intake zone having a substantially constant radius;

an expansion zone, adjacent said expansion intake zone in the direction of rotation of said rotor body, the chamber wall within said expansion zone having a radius that increases;

an outlet port zone adjacent to and symmetrical with said inlet port zone;

an inlet port formed in said chamber wall of said inlet port zone, providing fluid communication between said inlet port zone and the space;

a compression outlet port formed in said chamber wall of said compression outlet zone;

an expansion inlet port formed in said chamber wall of said expansion inlet port zone; and an outlet port formed in said chamber wall of said outlet port zone, providing fluid communication between said outlet port zone and the space; and heat exchanger means in fluid communication with said compression outlet port zone and said expansion inlet port zone through said compression outlet port and said expansion inlet port.

2. The low-pressure, air cycle cooling device of claim 1, wherein said rotor assembly includes vane springs carried in each said vane slot inward of said rotor vanes, for outwardly biasing said rotor vanes.

3. The low-pressure, air cycle cooling device of claim 1, wherein said rotor vanes include rotor vane tips having a generally semicircular profile.

4. The low-pressure, air cycle cooling device of claim 1, wherein said rotor assembly, includes eight said circumferentially spaced radial slots.

* * * * *